US006460829B1

(12) United States Patent
Forbis et al.

(10) Patent No.: US 6,460,829 B1
(45) Date of Patent: Oct. 8, 2002

(54) FENCE SYSTEM WITH VARIABLE POSITION RAIL

(75) Inventors: John T. Forbis; Randy Quaintance, both of York, NE (US); Ronald R. West, Provo, UT (US)

(73) Assignee: Kroy Building Products, Inc., York, NE (US)

( * ) Notice: Subject to any disclaimer, the term of this patent is extended or adjusted under 35 U.S.C. 154(b) by 0 days.

(21) Appl. No.: 09/232,118

(22) Filed: Jan. 15, 1999

(51) Int. Cl.[7] ..... E04H 17/14
(52) U.S. Cl. ..... 256/65; 256/24
(58) Field of Search ..... 256/65–69, 59, 256/24, 21

(56) References Cited

U.S. PATENT DOCUMENTS

| | | | | |
|---|---|---|---|---|
| 3,712,590 A | | 1/1973 | Tochner et al. | 256/34 |
| 3,955,799 A | * | 5/1976 | Lauzier | 256/65 X |
| 4,027,855 A | | 6/1977 | Lauzier | 256/65 X |
| 4,188,019 A | | 2/1980 | Meredith | 256/73 X |
| 4,346,872 A | * | 8/1982 | Tornya | 256/65 |
| 4,586,697 A | * | 5/1986 | Tornya | 256/65 |
| 5,011,325 A | | 4/1991 | Antonioli | 256/13.1 |
| 5,200,240 A | | 4/1993 | Baker | 256/73 X |
| 5,695,174 A | * | 12/1997 | Tsai | 256/59 X |

OTHER PUBLICATIONS

Two (2) end–view photocopies of a product currently being produced and sold by Thermal Industries, Inc.

* cited by examiner

*Primary Examiner*—Lynne H. Browne
*Assistant Examiner*—John R. Cottingham
(74) *Attorney, Agent, or Firm*—Clayton, Howarth & Cannon, P.C.

(57) ABSTRACT

A modular fence system. The system includes fence planks designed for insertion into open channels of upper and lower fence rails. The fence rails are supported in a horizontal orientation between intermittent fence posts, with the open channels facing toward a vertical direction and with the fence planks extending vertically between the rails and into the channels. The planks preferably include resilient protrusions at their upper ends. The protrusions of the planks are designed to fit into internal passages formed in the open channels of the upper fence rail, into engagement with ledges defining the passages, to inhibit inadvertent removal of the planks from the upper rail. The fence rails can also be used in a different way and in a different position, in which the open channels face toward a horizontal direction, with an elongate cap coupled to the rail to cover the open channel. Plank members are coupled to the cap such that the cap resides between the plank members and the rail.

1 Claim, 7 Drawing Sheets

FENCE SYSTEM WITH VARIABLE POSITION RAIL

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. The Field of the Invention

The present invention relates generally to modular fence systems, and more particularly, but not exclusively, to a fence system having a multi-position rail that can be used in various positions in constructing different fence designs.

2. Description of Related Art

The prior art modular fence systems are characterized by a number of disadvantages. Some systems require the laborious and time consuming practice of manufacturing modular components that are useable only with one design. Some of the more decorative-oriented fence systems are difficult to install.

BRIEF SUMMARY AND OBJECTS OF THE INVENTION

It is therefore an object of the present invention to provide a fence system that is simple in design and easier to assemble.

It is another object of the invention to provide such a fence system that utilizes a support rail capable of being used in at least two orientations as part of at least two different fence system designs.

The above objects and others not specifically recited are realized in a specific illustrative embodiment of a modular fence system. The system includes fence planks designed for insertion into open channels of upper and lower fence rails. The fence rails are supported in a horizontal orientation between intermittent fence posts, with the open channels facing toward a vertical direction and with the fence planks extending vertically between the rails and into the channels. The planks preferably include resilient protrusions at their upper ends. The protrusions of the planks are designed to fit into internal passages formed in the open channels of the upper fence rail, into engagement with ledges defining the passages, to inhibit inadvertent removal of the planks from the upper rail. The fence rails can also be used in a different way and in a different position, in which the open channels face toward a horizontal direction, with an elongate cap coupled to the rail to cover the open channel. Plank members are coupled to the cap such that the cap resides between the plank members and the rail.

Additional objects and advantages of the invention will be set forth in the description which follows, and in part will be apparent from the description, or may be learned by the practice of the invention without undue experimentation. The objects and advantages of the invention may be realized and obtained by means of the instruments and combinations particularly pointed out in the appended claims.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION OF THE INVENTION

Figure 1:
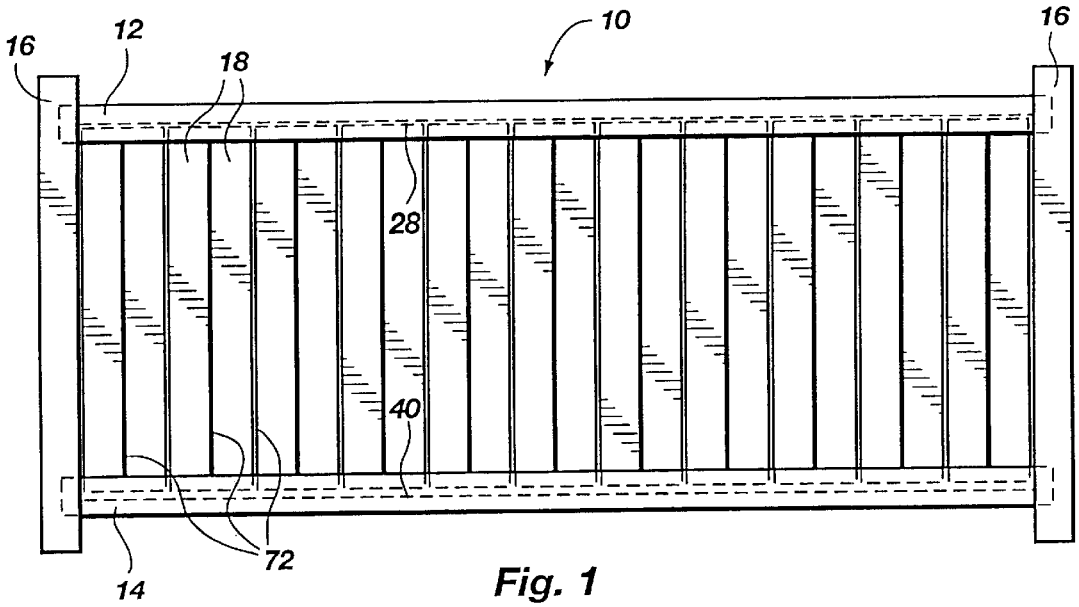
FIG. 1 is a frontal view of a fence system, made in accordance with the principles of the present invention.

For the purposes of promoting an understanding of the principles in accordance with the invention, reference will now be made to the embodiments illustrated in the drawings and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would normally occur to one skilled in the relevant art and having possession of this disclosure, are to be considered within the scope of the invention claimed.

Figure 2:
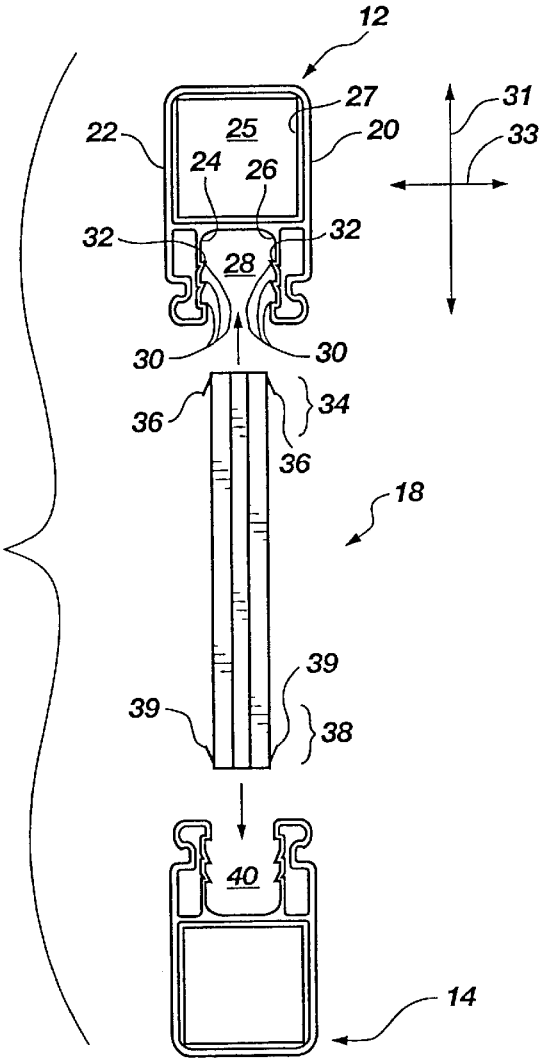
FIG. 2 is an exploded end view of a fence plank and upper and lower fence rails of the fence system of FIG. 1.
Figure 2A:
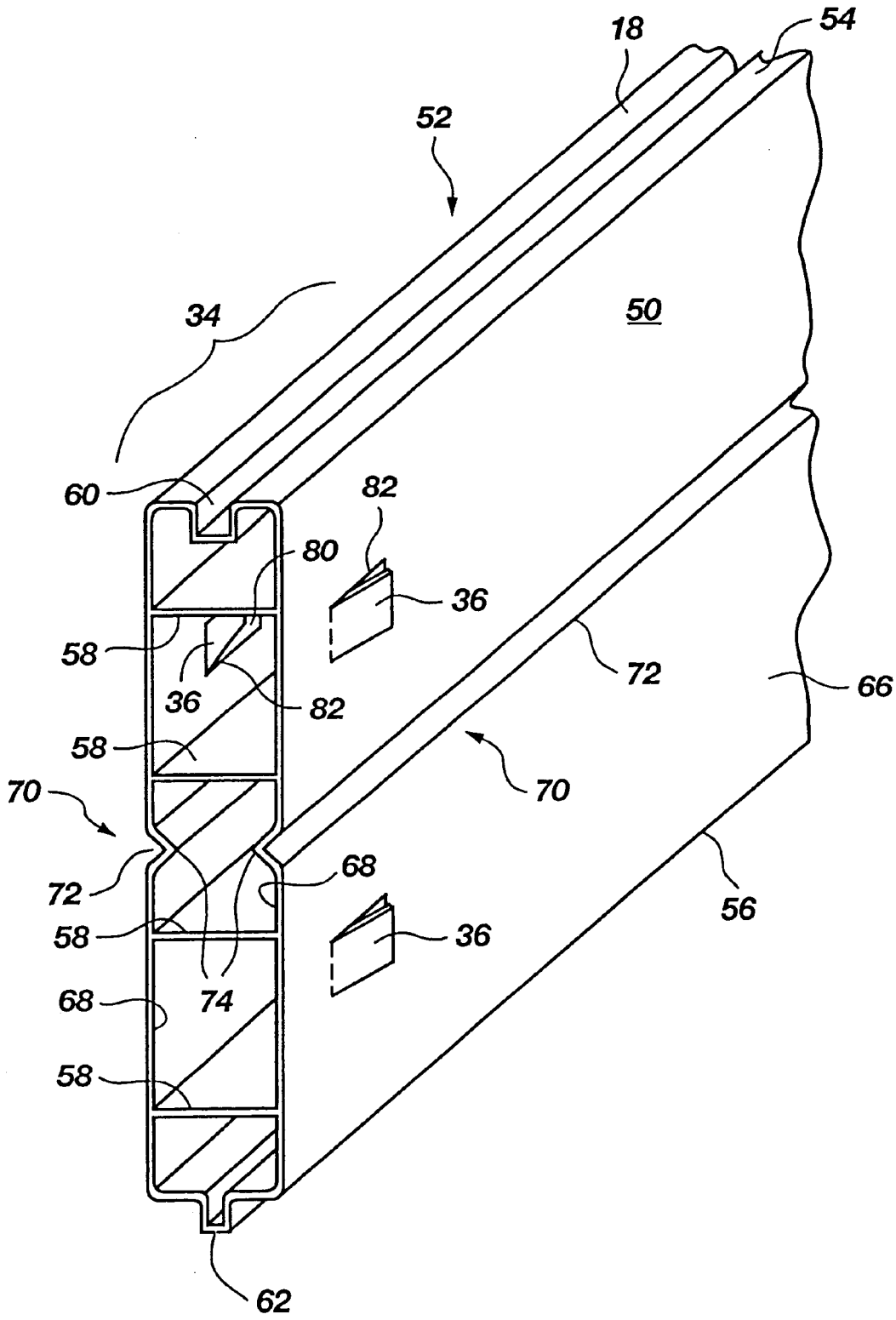
FIG. 2A is a perspective, break away view of the fence plank of FIG. 2.

Referring now to FIGS. 1, 2 and 2A, there is shown a fence system designated generally at 10 in FIG. 1. The fence system 10 preferably includes upper and lower fence rails 12 and 14 coupled to intermittent fence posts 16. A plurality of fence planks 18 are supported between the upper and lower fence rails 12 and 14. The upper fence rail 12 is thus configured to be supported in a laterally extending, elevated orientation.

The upper fence rail 12 comprises a first side 20 and an opposing second side 22. A first interior side wall 24 and an opposing second interior sidewall 26 define an open channel 28 therebetween. The upper fence rail 12 preferably includes ledges or projections 30 protruding outwardly from the first and second interior sidewalls 24 and 26, respectively, for supporting the fence planks 18 thereon. Each ledge 30 defines a passage 32.

Each plank 18 preferably includes a first exterior end section 34 configured for inserting into the open channel 28 of the upper fence rail 12. Protrusions 36 are preferably formed in the planks 18 and extend outwardly from opposing sides of the first exterior end section 34 for protruding into the passages 32 defined by the ledges 30 on the first and second interior sidewalls 24 and 26, respectively. The protrusions 36 are preferably resilient with elastic memory, and engage against the protruding ledges 30 to inhibit inadvertent removal of the planks 18 from the upper fence rail 12.

In this manner, the upper fence rail 12 provides structural support for the fence planks 18. The planks 18 are thus supported by both the upper and lower fence rails 12 and 14, as opposed to prior art fence systems wherein only the lower fence rail supports the planks. The fence posts 16 are preferably spaced close enough together to inhibit substantially sagging of the lower fence rail 14. Since the fence system 10 distributes the weight of the planks 18 between both the upper rail 12 and the lower rail 14, the frequency of the fence posts 16 is less and thus fewer fence posts 16 are required, resulting in a saving of material cost and labor of installation.

Each fence plank 18 further includes a second end section 38 opposite the first end section 34, and protrusions 39 may be formed in said section end section. The lower fence rail 14 also has an open channel 40 formed therein for receiving the second end sections 38 of the planks 18 thereinto. The lower fence rail 14 is preferably identical to the upper fence rail 12 in design, and includes the ledges and passages, as shown in FIG. 2.

The ledges 30 preferably comprise first and second arrays of elongate ledges extending lengthwise along the first and second interior sidewalls 24 and 26, respectively, to enable selective engagement of the protrusions 36 of the fence planks 18 against the ledges 32 of the first and second arrays, respectively. Preferably, each array of elongate ledges 30 comprises at least two ledges disposed in substantial parallel orientation as shown. The ledges 30 of the first and second arrays are equal in number to define pairs of ledges, each pair comprising a ledge from the first array and a ledge from the second array, such that the ledges in each pair are substantially parallel and reside common to a single plane extending substantially perpendicular to the sides 20 and 22 of the rail 12.

The upper fence rail 12 and the sidewalls 20, 22 and ledges 30 thereof preferably comprise a one-piece, unitary member made of a resilient material having elastic memory, such as vinyl. The protrusions 36 of the planks 18 also preferably comprise a resilient material having elastic memory. The feature of resilient material having elastic memory operates to permit a locking engagement of the protrusions 36 into the passages 32. The protrusions 36 can be "snapped" into place into the passages 32.

Referring more particularly to FIG. 2A, the fence planks 18 are preferably hollow, each plank having a front wall 50, an opposing rear wall 52, and a left sidewall 54 and a right sidewall 56 coupled between the front and rear walls 50 and 52 at opposing sides thereof, respectively. A plurality of internal bracing walls 58 are preferably disposed between the rear wall 52 and the front wall 50. The left sidewalls 54 have an elongate channel 60 formed therein, and the right sidewalls 56 have an elongate projection 62 formed thereon configured and dimensioned to be inserted into the channel 60 of the left sidewalls 54 of adjacent planks 18 for additional support.

The front and rear walls 50 and 52 of each plank 18 include an exterior surface 66 and an interior surface 68, and preferably an elongate groove 70 is formed in each of said front and rear walls extending lengthwise along the plank 18. The elongate grooves 70 in the front and rear walls comprise a crease in said front and rear walls, defined by a furrow 72 formed in the exterior surface 66, and an opposing ridge 74 formed in the interior surface 68. The grooves 70 are optional, and the front and rear walls 50 and 52 may alternatively comprise substantially planer walls characterized by an absence of grooves or other nonplaner structure.

The grooves 70 define a kind of "V" shape as shown in FIG. 2A. The "V" grooves 70 provide an enhanced aesthetic appeal to the planks 18. The planks 18 preferably comprise a cross section of one inch by 8 inches, and the "V" grooves 70 produce the appearance four inch planks even though the planks are eight inches wide in reality.

Regarding the protrusions 36, the front and rear walls 66 and 68 of the planks 18 each include an opening 80 formed in the first end section 34 of the plank 18, such that a circumferential edge 82 defines said opening 80. The protrusions 36 extend outwardly from a portion of said circumferential edges 82. Most preferably, the protrusions 36 each comprise a severed portion of the walls 50 and 52 of the planks 18, whereby the protrusions 36 are simply cut apart from the front and rear walls 50 and 52 to form the openings 80, and the protrusions 36 are crimped into an outwardly extending orientation.

It is to be understood that one aspect of the present invention contemplates the plank 18 as in FIG. 2A without the protrusions 36 formed thereon. The upper and lower fence rails could simply function as retaining channels, such that no part of the plank extends into the passages 32 in a locking relationship against the ledges 30.

The multi-position rail 12 preferably includes a hollow portion 25, with a reinforcement member 27 disposed within the hollow portion 25 of the rail 12. The reinforcement member 27 is tubular and has a cross sectional shape that is similar to a cross sectional shape of the hollow portion 25 of the rail 12.

Figure 2B:
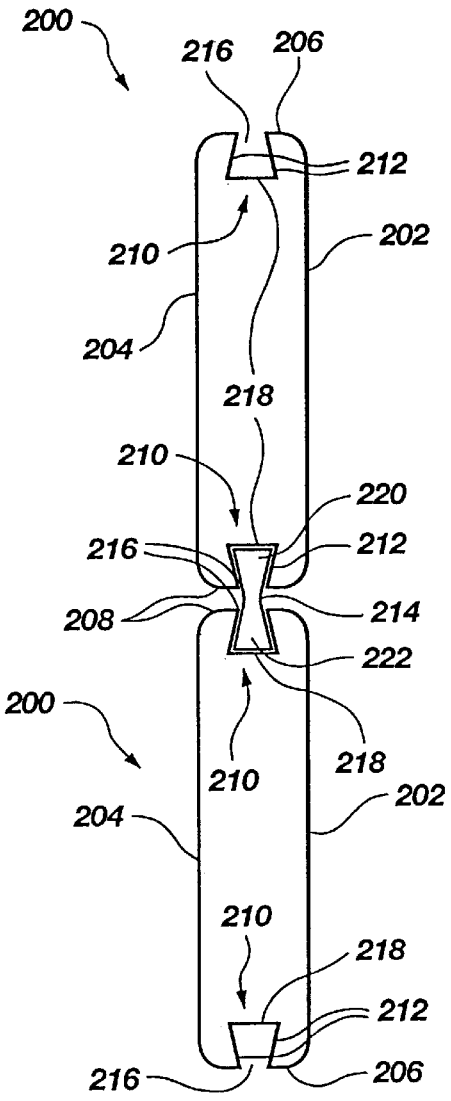
FIG. 2B is a plan view of a first alternative embodiment of the plank of FIGS. 2 and 2A, showing two such first alternative planks intercoupled with a first joining device.
Figure 2D:
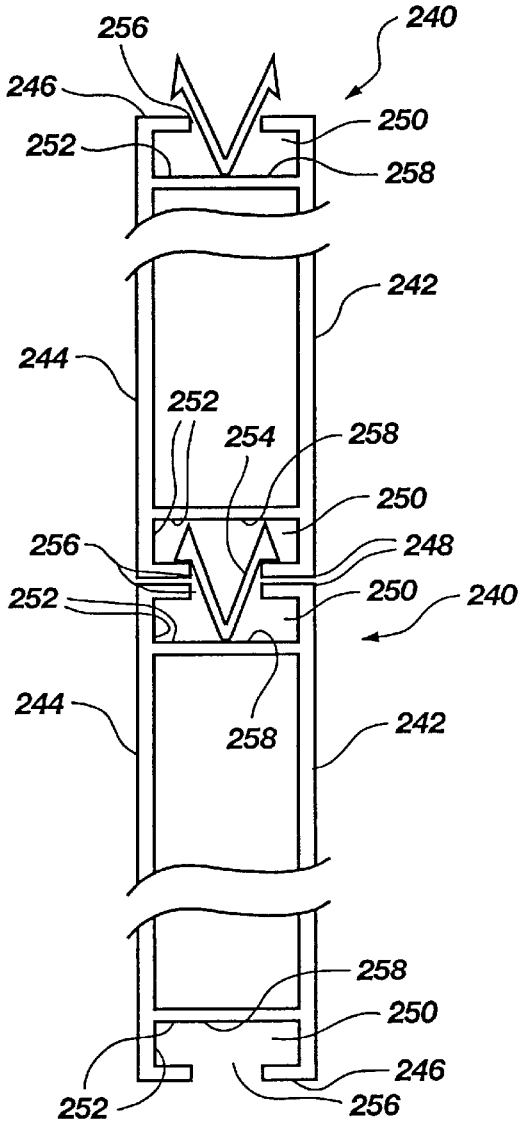
FIG. 2D is a plan view of a second alternative embodiment of the plank of FIGS. 2 and 2A, showing two such second alternative planks intercoupled with a second joining device.
Figure 2C:
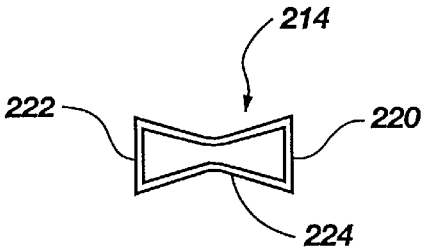
FIG. 2C is an isolated view of the first joining device of FIG. 2B.

Referring now to FIGS. 2B and 2C, there is shown an alternative embodiment of a plank, designated generally at 200. Each plank 200 has a front wall 202, rear wall 204, and first and second endwalls 206 and 208, respectively. Each endwall 206 and 208 has a cavity 210 formed therein defined by cavity-defining walls 212. A joining means 214 is provided for engaging against the cavity-defining walls 212 within cavities 210 of adjacent endwalls 208 of two adjacent planks 200 as shown in FIG. 2B to thereby join said two adjacent planks 200.

The cavities 210 in the endwalls 206 and 208 each preferably comprise an elongate, open channel having an elongate opening 216 extending along a length of said open channel 210. The channel 210 is defined by a bottom channel wall 218 that is wider than the elongate opening 216. The joining means 214 preferably comprises an elongate strip, shown in cross section most clearly in FIG. 2C. The cross section of the joining means or strip 214 has a first wide end 220, an opposing second wide end 222, and an intermediate section 224 that is narrower than the first wide end 220 and the second wide end 224.

The joining means or elongate strip 214 is configured and dimensioned to reside slidably disposed within first and second adjacent open channels 210 of first and second adjacent endwalls 208 of first and second adjacent planks 200. The first wide end 220 resides within the first open channel 210 and the second wide 222 end resides within the second open channel 210 of the adjacent endwalls 208 as shown in FIG. 2B, wherein the first wide end 220 is wider than the elongate opening 216 of the first open channel 210 and the second wide end 222 is wider than the elongate opening 216 of the second open channel 210 to prevent the wide ends 220 and 222 of the elongate strip 214 from moving through said elongate openings 216.

Figure 2E:
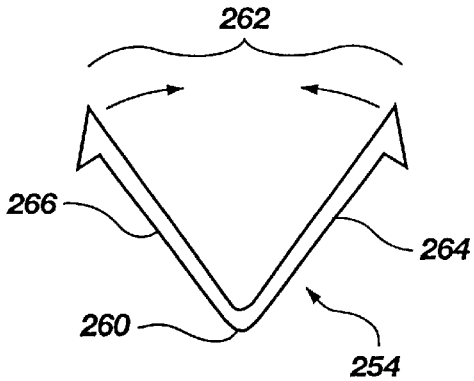
FIG. 2E is an isolated view of the second joining device of FIG. 2D.

Referring now to FIGS. 2D and 2E, there is shown another alternative embodiment of a plank, designated generally at 240. Each plank 240 has a front wall 242, rear wall 244, and first and second endwalls 246 and 248, respectively. Each endwall 246 and 248 has a cavity 250 formed therein defined by cavity-defining walls 252. A joining means 254 is provided for engaging against the cavity-defining walls 252 within cavities 250 of adjacent endwalls 248 of two adjacent planks 240 as shown in FIG. 2D to thereby join said two adjacent planks 240.

The cavities 250 in the endwalls 246 and 248 each preferably comprise an elongate, open channel having an elongate opening 256 extending along a length of said open channel 250. The channel 250 is defined by a bottom channel wall 258 that is wider than the elongate opening 256. The joining means 254 preferably comprises an elongate V-strip, shown in cross section most clearly in FIG. 2E. The cross section of the joining means or V-strip 254 has a narrow edge 260, and an opposing wide portion 262.

The joining means or elongate strip 254 is an expansion/contraction means for being inserted into an elongate open channel 250 of an endwall 248 of a plank 240 and thereafter expanding into engagement with walls 252 defining said elongate open channel 250. The expansion/contraction means in the form of a resilient, V-shaped member 254 has resiliency and elastic memory and further includes a first arm 264 and a second arm 266 joined to said first arm 264, said first and second arms 264 and 266 being moveable toward each other by operation of the resiliency when a compressive force is applied to said first and second arms 264 and 266. The elastic memory operates to force the first and second arms 264 and 266 outwardly away from each other with the compressive force is released. The first and second arms 264 and 266 are elongate to form the V-shaped member 254, and as such may also be described as sides or walls. However, it is to be understood that the V-shaped member 254 need not necessarily be elongate and may constitute a clip instead of a longer, trough-type V-shaped channel type member if desired.

The elongate V-strip or V-shaped member 254 may be coupled at a narrow edge 260 thereof to a wall 258 defining an open channel 250 of an endwall 248 of a first plank 240 as shown in FIG. 2D, and the wide portion 262 of the V-strip is configured and dimensioned to reside slidably disposed within an open channel 250 of a second plank 240 positioned adjacent said first plank 240, as shown in FIG. 2E.

Figure 3:
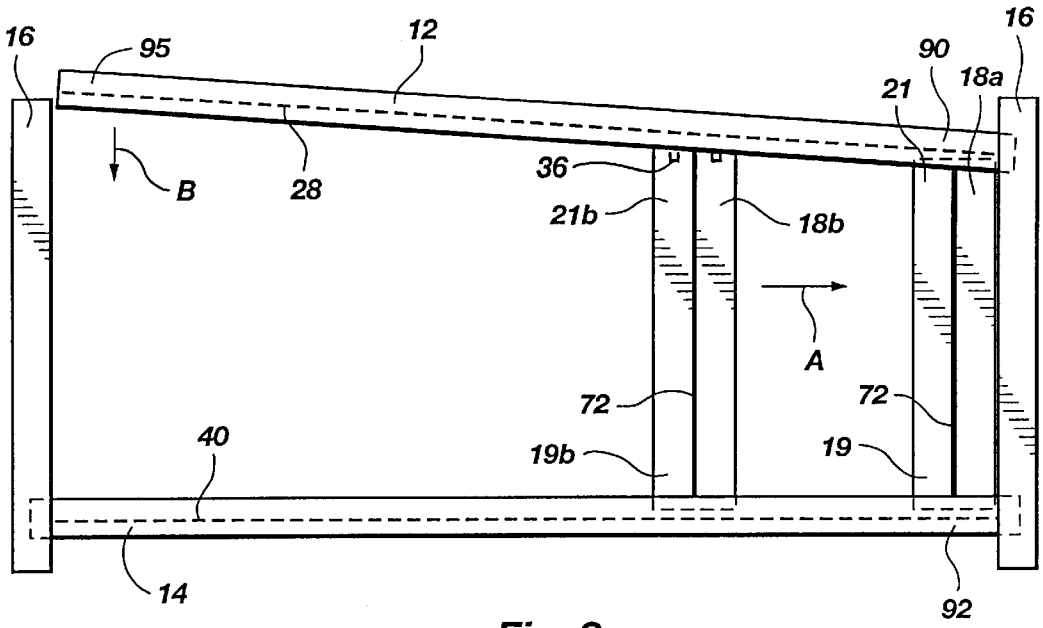
FIG. 3 is a frontal view of a partially assembled fence system being assembled in accordance with the principles of the present invention.
Figure 4:
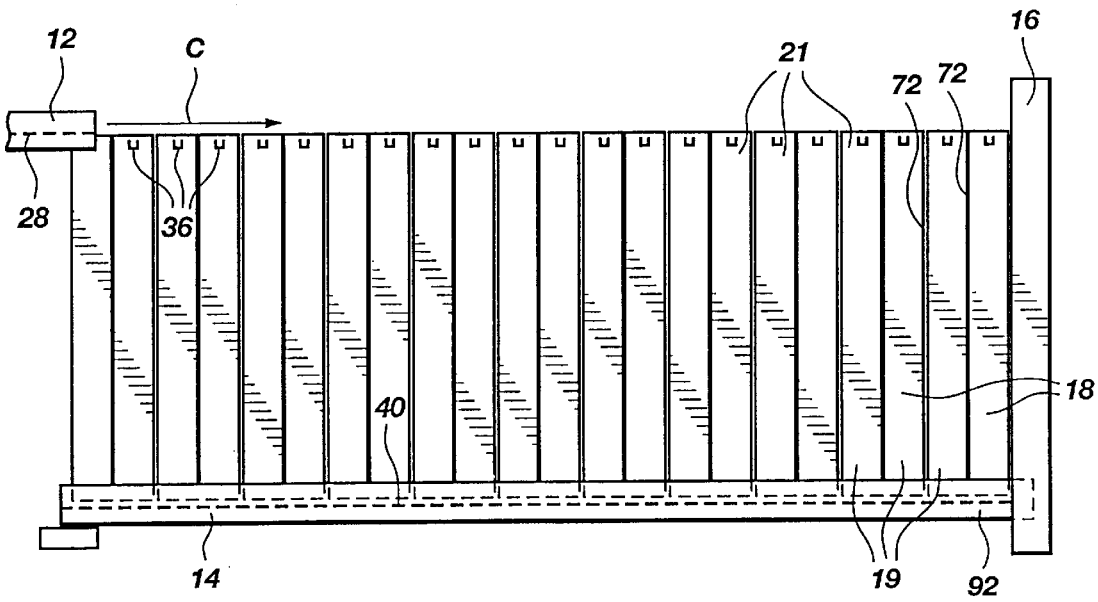
FIG. 4 is a frontal view of a partially assembled fence system being assembled in accordance with an alternative method of assembly.

The fence system 10 can be assembled in any suitable manner. Referring now to FIG. 3, a preferred method of assembling a fence comprises the steps of:

(a) coupling a first end 90 of an upper fence rail 12 and a first end 92 of a lower fence rail 14 to a fence post 16, and maintaining an opposing second end 95 of the upper fence rail 12 in an elevated orientation with relative to the first end 90 of said upper fence rail 12;

(b) placing a lower end 19 of a first fence plank 18*a* into an open channel 40 of the lower fence rail 14, and an opposing upper end 21 of said first fence plank 18*a* into an open channel 28 of the upper fence rail 12;

(c) placing a lower end 19*b* of a following fence plank 18*b* into the open channel 40 of the lower fence rail 14 and sliding said following fence plank 18*b* toward the first fence plank 18*a* (as illustrated by arrow A);

(d) gradually lowering the second end 95 of the upper fence rail 12 (as illustrated by arrow B) such that an upper end 21*b* of the following fence plank 18*b* becomes received into the open channel 28 of the upper fence rail 12;

(e) repeating steps (c) and (d) as many times as desired to thereby situate an array of fence planks 18 into position between the upper and lower fence rails 12 and 14.

The method set forth immediately above may be further augmented, wherein step (b) further comprises placing a protrusion 36 of the first fence plank 18*a* into an internal passage 32 (see FIG. 2) 28 of the upper fence rail 12 and into engagement with a ledge 30 defining the passage, and wherein step (d) further comprises placing a protrusion 36 of the following fence plank 18*b* into an internal passage 32 of the upper fence rail 12. and into engagement with a ledge 30 defining said internal passage.

Figure 6:
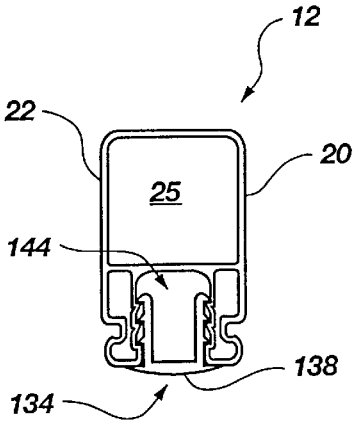
FIG. 6 is a side, cross-sectional view of an upper rail and attached spacer of the fence system of FIG. 5.

Referring now to FIG. 6, a further method of assembling a fence comprises the steps of:

(a) coupling a first end 92 of a lower fence rail 14 to a support post 16;

(b) placing lower ends 19 of a plurality of fence planks 18 into an open channel 40 of the lower fence rail 14; and (c) sliding an upper fence rail 12 onto upper ends 21 of the plurality of fence planks 18 (illustrated by arrow C) such that said upper ends 21 of the planks 18 reside in an open channel 28 of the upper fence rail 12 with protrusions 36 on said upper ends 21 extending into an internal passage 32 (shown in FIG. 2) of the upper fence rail 12 and into engagement with a ledge 30 (shown in FIG. 2) defining said internal passage.

The method set forth immediately above may be further augmented, wherein step (c) further comprises sliding the upper fence rail 12 sequentially along the upper ends 21 of the plurality of fence planks 18.

Figure 8:
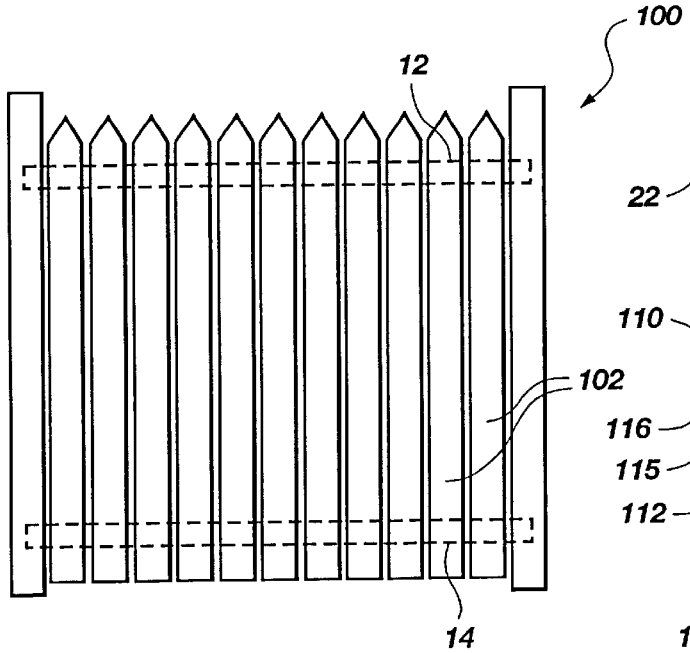
FIG. 8 is a frontal view of a further alternative embodiment of the fence system of FIG. 1.
Figure 9:
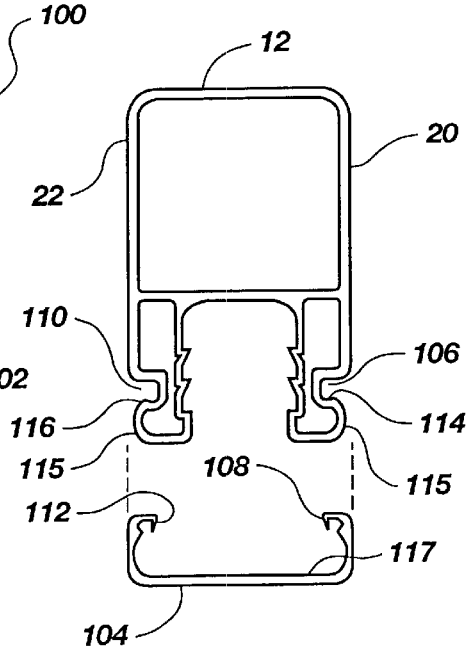
FIG. 9 is an exploded end view of a rail and rail cap of the fence system of FIG. 8.
Figure 10:
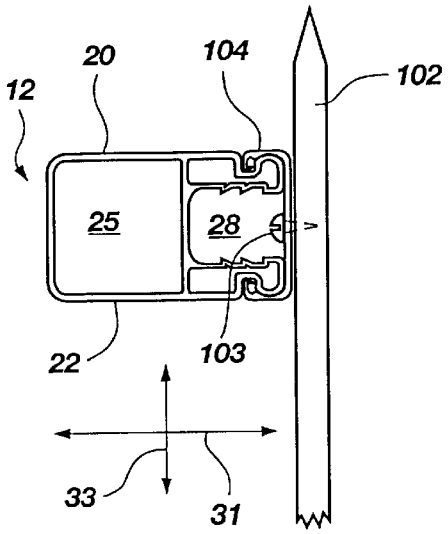
FIG. 10 is a break-away side view of a rail, attached rail cap and fence plank of FIG. 8.

Referring now to FIGS. 8–10, there is shown an alternative embodiment of the fence system 10 shown above in FIG. 1, designated generally at 100. The fence rails 12 and 14 in FIG. 1 are identical to the fence rails 12 and 14 in FIGS. 8–10.

The fence rail 12 constitutes a rail means configured to be supported in a laterally extending orientation for supporting a plurality of fence planks in a fixed position. The fence planks 102 are configured and arranged to be supported by the rail 12.

A cap means 104 is provided for covering a portion of the rail 12 and intercoupling the rail 12 and the fence planks 102 such that said cap means 104 resides between said rail 12 and said fence planks 102. The cap means 104 constitutes an elongate cap member configured and dimensioned to clamp onto the rail 12. The cap means 104, and the assembly of said cap means 104 with the fence planks 102 and rail 12, operate as shown in FIG. 10 to conceal from view any screws, rivets or other fastening means used to fasten together the fence planks 102 to the cap means 104, such as screw member 103.

The rail 12 preferably includes a first elongate groove 106 formed along the first side 20 thereof, and the cap means 104 includes locking means 108 for engaging against the rail 12 within the first elongate groove 106 to thereby lock the cap means 104 in place onto the rail 12.

The rail 12 may further include a second elongate groove 110 formed along the second side 22 thereof. Locking means further includes means 112 for engaging against the rail 12 within the second elongate groove 110.

The rail 12 further preferably comprises a first elongate lip 114 that defines a portion of the first elongate groove 106, and the locking means 108 constitutes a first elongate spline as shown. The spline 108 is configured and dimensioned to engage against the first elongate lip 114 when the cap means 104 is locked into place onto the rail 12.

The rail 12 may also include a second elongate lip 116 that defines a portion of the second elongate groove 110, and the locking means 112 constitutes a second elongate spline configured and dimensioned to engage against the second elongate lip 116 when the cap means 104 vis locked into place onto the rail 12.

Figure 13:
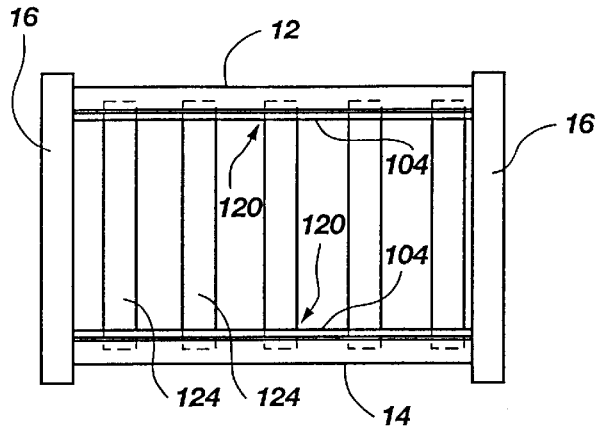
FIG. 13 is a frontal view of a fence system utilizing the embodiment of the rail and rail cap of FIG. 11.
Figure 11:
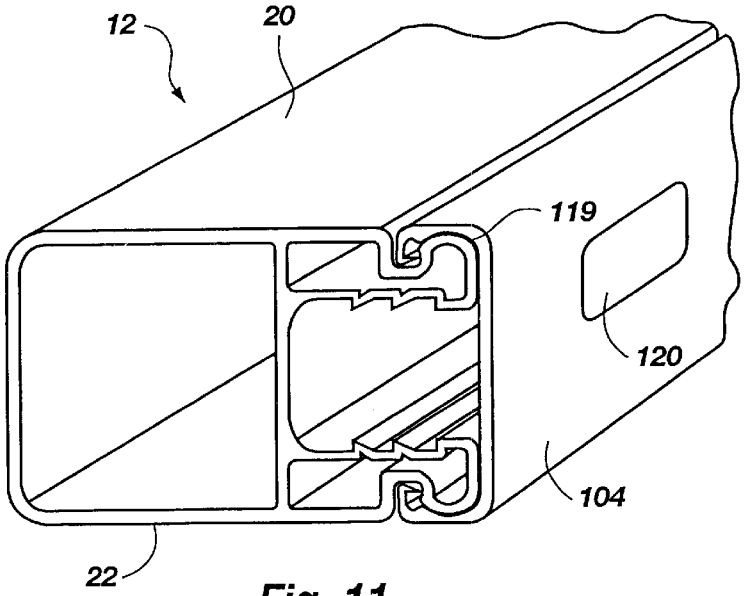
FIG. 11 is a perspective, break-away view of an alternative embodiment of the rail and rail cap of FIGS. 8, 9 and 10.

Referring now to FIGS. 11 and 13, the cap means 104 may include spaced-apart openings 120 formed therein for receiving the fence planks 124 therethrough, respectively.

The cap means 104 extends along the rail 12 in a parallel orientation with respect to said rail 12, and both the planks 124 of FIG. 13 and the planks 102 of FIG. 8 are disposed in a substantial orthogonal orientation with respect to the rail 12 and the cap means 104.

The cap means 104 is configured and dimensioned to cover at least a portion of the channel 28 and wherein the planks 102 are coupled to the cap means 104 such that the cap means resides between the rail 12 and the planks 102. The planks 102 may be referred to herein as "picket members," as item 102 is shown in FIG. 10 resembling a picket member in the manner that a "picket" is known to those skilled in the relevant field.

Referring now to FIG. 9, the rail 12 preferably comprises a rounded, convex exterior surface 115 as shown, and the cap means 104 comprises a rounded, concave interior surface 117 having a similar degree of curvature as the rounded, exterior surface of the rail 12, as shown most clearly in FIGS. 10–11. The cap means 104 is disposed in a contiguous grip upon the rail 12 with the rounded, concave interior surface 117 of the cap means 104 disposed in contact with the rounded, convex exterior surface 115 of the rail 12, as indicated at 119 in FIG. 11.

It will be appreciated from the above, and by inspection of FIGS. 1–2 and 8–11, that the rail 12 constitutes a multi-position rail configured to be supported in a laterally extending, elevated orientation, said rail 12 including supporting means for (i) supporting a first boundary-defining barrier means in vertical alignment with respect to said rail when said rail is disposed in a first orientation, and (ii) supporting a second boundary-defining barrier means in a lateral orientation with respect to said rail when said rail is disposed in a second orientation. The boundary-defining barrier means is configured and arranged to be supported by the rail 12.

More specifically, the multi-position rail 12 includes a cross section having a first, longer dimension 31 and a second, shorter dimension 33. The first, longer dimension 31 extends in a substantial vertical direction when the rail 12 is disposed in the first orientation, as indicated most clearly in FIG. 2. The second, shorter dimension 33 extends in a substantial vertical direction when rail 12 is disposed in the second orientation, as indicated most clearly in FIG. 10.

The barrier means preferably comprises the planks 18 or the planks 102, but could alternatively comprise lattice or any other suitable barrier member. The supporting means includes the walls 24 and 26, and may further include the cap means 104.

Figure 5:
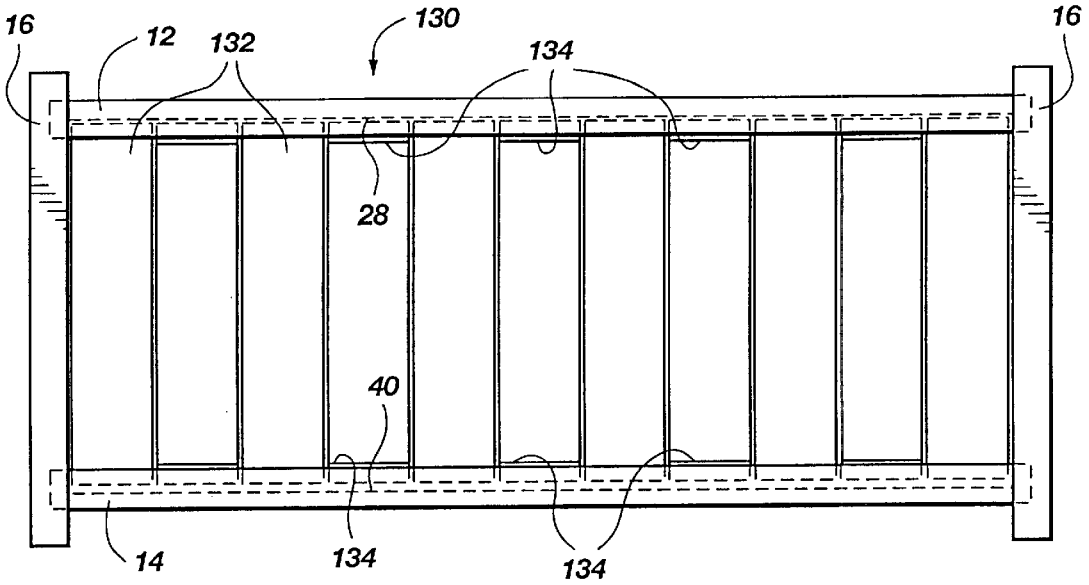
FIG. 5 is a frontal view of an alternative embodiment of the fence system of FIG. 1.
Figure 5A:
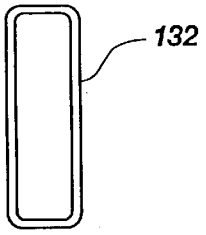
FIG. 5A is a cross-sectional view of a fence plank of the fence system of FIG. 5.

Referring now to FIGS. 5–7, there is shown a further fence system designated generally at 130. The rail 12 is the same rail, in construction, configuration and dimension, as shown in FIGS. 1–2 and 8–11. The fence planks 132 are shown in cross section in FIG. 5A, and preferably comprise a substantially rectangular cross section having four sides, each side being characterized by an absence of bumps or grooves as shown. A spacing means 134 is provided for being inserted into the rail 12 between at least some of the fence planks 132 to thereby maintain a minimum spacing between said at least some of the fence planks 132.

Figure 7A:
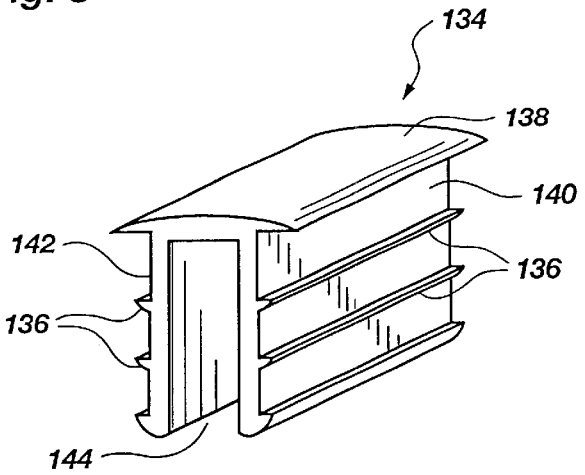
FIG. 7A is a perspective view of the spacer of FIG. 6.

The spacing means 134 is shown most clearly in FIG. 6–7A, in the form of spacers comprising a plurality of ribs 136 formed thereon. Each spacer 134 includes an upper wall 138, a first sidewall 140 and an opposing second sidewall 142, said first and second sidewalls 140 and 142 extending from the upper wall 138 in a substantial parallel orientation to form a channel 144 therebetween.

Each spacer 134 is preferably made of a resilient material having elastic memory to thereby enable the first and second sidewalls 140 and 142 to flex inwardly toward each other when subjected to a compressive force.

Figure 7B:
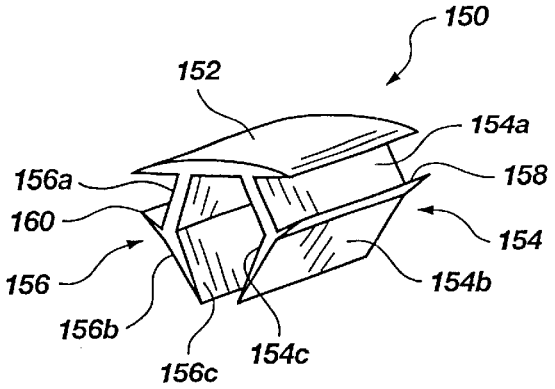
FIG. 7B is a perspective view of an alternative embodiment of the spacer of FIG. 7A.

Referring now to FIG. 7B, there is shown an alternative spacer, designated generally at 150. The spacer 150 includes an upper wall 152, and a first sidewall 154 having an upper section 154*a* and a lower section 154*b* that cooperatively form a non-straight angle therebetween. The spacer 150 further includes an opposing second sidewall 156 having an upper section 156*a* and a lower section 156*b* that cooperatively form a non-straight angle therebetween, such that the first and second sidewalls 154 and 156 each have a concave surface 154*c* and 156*c*, respectively, and wherein the concave surfaces are facing each other.

The first and second sidewalls 154 and 156 each preferably have a convex surface, and a first elongate rib 158 disposed on the convex surface of the first sidewall 154 and a second elongate rib 160 disposed on the convex surface of the second sidewall 156.

Figure 7C:
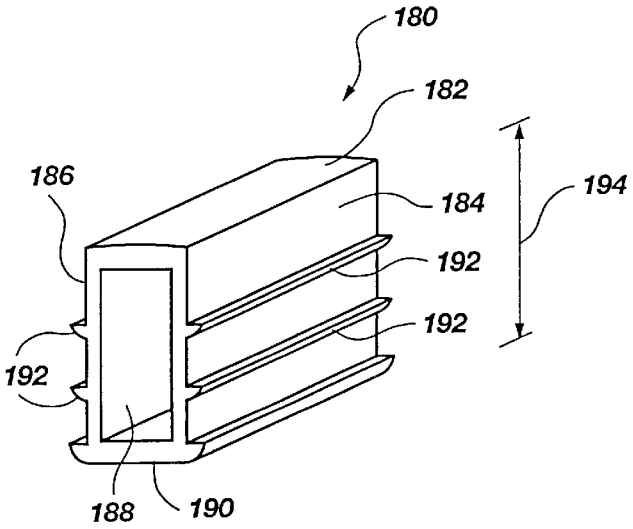
FIG. 7C is a perspective view of a still further alternative embodiment of the spacer of FIG. 7A.

Referring now to FIG. 7C, there is shown a still further alternative spacer, designated generally at 180. The spacer 180 includes an upper wall 182, a first sidewall 184 and an opposing second sidewall 186, said first and second sidewalls 184 and 186 extending from the upper wall 182 in a substantial parallel orientation to form a channel 188 therebetween. The spacer 180 further includes a lower wall 190, and ribs 192. Accordingly, the upper wall 182, bottom wall 190, first sidewall 184 and second sidewall 186 collectively form the channel 188 to be closed along its length.

The spacer 180 has a height 194 that is not larger than the depth of the open channels 28 and 40 of the rails 12 and 14, respectively, to thereby enable the spacer 180 to be placed completely into one of said open channels 28 and 40 such that every portion of the spacer 180 resides within said open channel.

Figure 12:
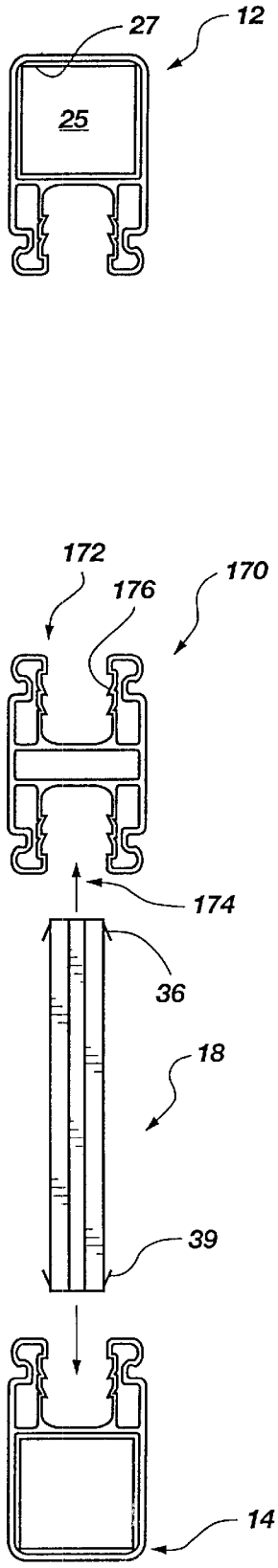
FIG. 12 is an exploded end view of an alternative embodiment of the fence planks and rails of FIG. 2.

Referring now to FIG. 12, there is shown a still further embodiment of a fence system. A key distinguishing feature of FIG. 12 is the rail means 170. The rail means 170 is configured to be supported in a laterally extending orientation for supporting a plurality of fence planks 18 in a fixed position. The rail means 170 further includes (i) an open upper channel 172 defining an elongate upper opening extending along at least a majority length of the rail means, and (ii) an open lower channel 174 defining an elongate lower opening extending along at least a majority length of the rail means, such that said rail means 170 has a generally H-shaped cross section as shown.

Any suitable barrier means may be inserted into the open upper channel 172 of the rail means 170 for defining an upper boundary extending along at least a portion of the rail means, such as fence planks, lattice, or any other suitable barrier means.

Any suitable second barrier means, such as the fence planks 18, may be inserted into the open lower channel 174 of the rail means 170 and for defining a lower boundary extending along at least a portion of the rail means 170. At least one of the channels is defined by a first sidewall and an opposing second sidewall and wherein at least one ledge 176 protrudes from one of said sidewalls into said at least one of the channels.

It will be appreciated that the spacers 134 and 150 of FIGS. 7A and 7B may be inserted into the rail means 170 of FIG. 12, between at least some of the fence planks 18 to thereby maintain a minimum spacing between said at least some of the fence planks 18.

It will be further appreciated that the cap means 104 of FIGS. 9–11 may be used for covering at least one of the channels 172 and/or 174 of FIG. 12.

It will be appreciated that the structure and apparatus disclosed herein in the form of walls 24 and 26 and related structure is merely one example of a supporting means for supporting a barrier means, and it should be appreciated that any structure, apparatus or system for supporting a barrier of any kind which performs functions the same as, or equivalent to, those disclosed herein are intended to fall within the scope of a supporting means for supporting a barrier, including those structures, apparatus or systems for supporting a barrier which are presently known, or which may become available in the future. Anything which functions the same as, or equivalently to, a supporting means for supporting a barrier means falls within the scope of this element.

It will be further appreciated that the structure and apparatus in the form of the rail cap means 104 disclosed herein is merely one example of a cap means for covering at least a portion of the open channels 28 or 40, and it should be appreciated that any structure, apparatus or system for covering an open channel which performs functions the same as, or equivalent to, those disclosed herein are intended to fall within the scope of a cap means for covering an open channel, including those structures, apparatus or systems for covering which are presently known, or which may become available in the future. Anything which functions the same as, or equivalently to, a cap means for covering an open channel falls within the scope of this element.

In accordance with the features and combinations described above, a preferred method of assembling a plurality of fences includes the steps of:

(a) selecting a first multi-position rail;.

(b) supporting the first multi-position rail in a laterally extending, elevated orientation such that said first multi-position rail is disposed in a first cross-sectional orientation, and.coupling a first barrier means to said rail such that the first barrier means and the rail are disposed in vertical alignment to thereby form a first fence;

(c) selecting a second multi-position rail having substantially the same cross-sectional dimensions as the first multi-position rail; and (d) supporting the second multi-position rail in a laterally extending, elevated orientation such that said second multi-position rail is disposed in a second cross-sectional orientation that is rotationally displaced in comparison to the first cross-sectional orientation, and coupling a second barrier means to said second multi-position rail such that the second barrier means and the second rail are disposed in a lateral orientation with respect to each other to thereby form a second fence.

A further preferred method of assembling a fence includes the steps of:

(a) selecting an elongate rail having an open channel formed as a portion of the rail, said open channel defining an elongate opening extending along at least a majority length of the rail;

(b) coupling an elongate cap member to the rail such that said cap member covers at least a portion of the open channel of the rail;

(c) coupling a barrier means to the cap member such that said barrier means extends from said cap member to form a fence.

A still further preferred method of assembling a fence includes the steps of:

(a) selecting an elongate rail having an open channel formed as a portion of the rail, said open channel defining an elongate opening extending along at least a majority length of the rail;

(b) coupling an elongate cap member to the rail such that said cap member covers at least a portion of the open channel of the rail, said cap member having spaced-apart openings formed therein;

(c) placing a plurality of fence planks through the openings of the cap member, respectively, such that said fence planks extend sequentially from the open channel of the rail through the openings of the cap member and away from the rail and cap member to thereby form a fence.

Still another method of assembling a fence includes the steps of:

(a) selecting an elongate rail having an open channel formed as a portion of the rail, said open channel defining an elongate opening extending along at least a majority length of the rail; and (b) inserting a plurality of ends of fence planks into the open channel such that said fence planks extend outwardly from said channel and inserting a plurality of spacers into the open channel and between the planks, respectively, to thereby maintain a minimum spacing between said planks.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function. and manner of operation, assembly and use may be made without departing from the principles and concepts set forth herein.

What is claimed is:

1. A fence system comprising:

a multi-position rail configured to be supported in a laterally extending, elevated orientation with respect to a reference plane, said rail including supporting means for (i) supporting a first boundary-defining barrier means in vertical alignment with respect to said rail when said rail is disposed in a first cross-sectional orientation, and (ii) supporting a second boundary-defining barrier means in a lateral orientation with respect to said rail when said rail is disposed in a second orientation; and a boundary-defining barrier means configured and arranged to be supported by the rail;

wherein the supporting means comprises:

a first interior side wall and an opposing second interior sidewall defining an open channel therebetween and an elongate opening extending along at least a majority length of the multi-position rail; and cap means for covering at least a portion of the open channel and intercoupling the rail and the boundary-defining barrier means such that said cap means resides between said rail and said barrier means;

wherein the fence system further comprises fastening means for fastening the barrier means to the cap means and wherein the rail, cap means and barrier means are configured and adapted to be assembled in a manner sufficient to conceal the fastening means from view, and wherein the fastening means comprises a plurality of threaded screws.

* * * * *